US005171015A

United States Patent [19]

Vale

[11] Patent Number: 5,171,015

[45] Date of Patent: Dec. 15, 1992

[54] GOLF CLUB AND TEE SUPPORT THEREFOR

[76] Inventor: Albert Vale, 266-C Middlebury La., Jamesburg, N.J. 08831

[21] Appl. No.: 803,516

[22] Filed: Dec. 9, 1991

[51] Int. Cl.[5] ..... A63B 53/00; A63B 57/00

[52] U.S. Cl. ..... 273/162 C; 273/162 F; 273/32 B

[58] Field of Search ..... 273/162 R, 162 A, 162 B, 273/162 C, 162 D, 162 E, 162 F, 81 R, 81 A, 81 B, 81 C, 81 D, 186 A, 194 R, 165, 32 R, 32 B, 32 D

[56] References Cited

U.S. PATENT DOCUMENTS

| | | | |
|---|---|---|---|
| 1,694,992 | 12/1928 | Stoeffler | 273/165 |
| 2,221,421 | 11/1940 | Curry | 273/81 R |
| 3,918,718 | 11/1975 | Billow | 273/162 D |
| 4,491,323 | 1/1985 | Kozub | 273/81 D |
| 4,880,240 | 11/1989 | Lewis | 273/81 B X |
| 4,907,810 | 3/1990 | Whiteford | 273/81 R X |
| 4,927,151 | 5/1990 | Ronnick | 273/162 B |

FOREIGN PATENT DOCUMENTS

| | | | |
|---|---|---|---|
| 772931 | 4/1957 | United Kingdom | 273/162 F |

*Primary Examiner*—George J. Marlo

*Attorney, Agent, or Firm*—Abraham Wilson; Robert A. Green

[57] ABSTRACT

The disclosure is of a golf club having a grip provided with a small hole which can receive the sharp, tip end of a tee. With a tee inserted in the hole, the club can be laid on grass with the grip supported away from the grass and thus not affected by water or other materials on the grass.

1 Claim, 1 Drawing Sheet

GOLF CLUB AND TEE SUPPORT THEREFOR

BACKGROUND OF THE INVENTION

During the playing of a game of golf, it is often necessary for a player to lay his club down on the grass while he performs some task. If the grass is wet or damp, the player must wipe the club handle before he can continue play and this is undesirable because it takes time, requires the player to carry a drying cloth and the drying may not be as complete as desired.

SUMMARY OF THE INVENTION

Briefly according to the invention, the handle of a golf club is provided with a small hole of a size suitable to receive the pointed end of a tee. With the end of the tee inserted in the hole the club can be laid down on the grass with the handle raised above the grass by the tee. The handle thus remains dry.

DESCRIPTION OF THE INVENTION

Figure 1:
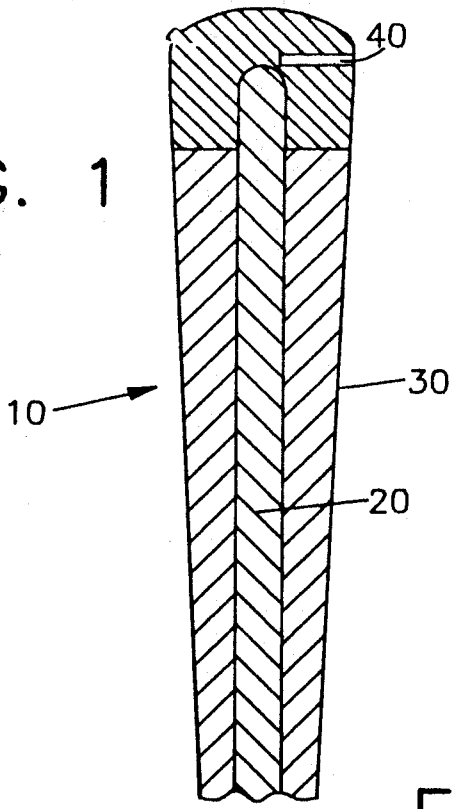
FIG. 1 is a front elevational view of a handle of a golf club embodying the invention.
Figure 2:
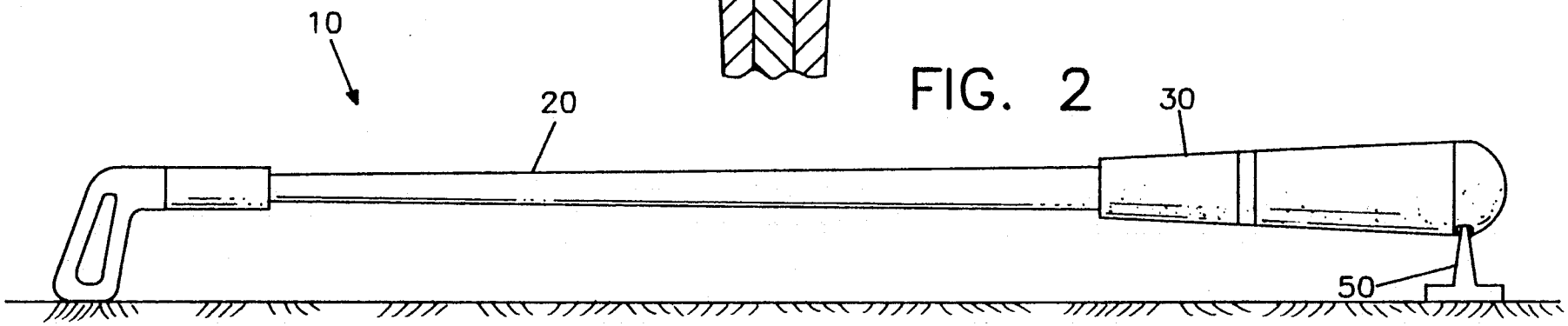
FIG. 2 is a side elevational view of a golf club and a tee and illustrating the operation of the invention.

Referring to FIGS. 1 and 2, a golf club 10, of any type includes a shaft 20 and a handle or grip 30. The club has a long or longitudinal axis. The club may be any type of club used in playing golf and the handle or grip may be of any desired form and material.

According to the invention, close to the upper end 40 of the grip is provided a hole 40 extending inwardly from the outer surface of the grip and of a length of about ½ inch and a depth of about 5/32 inch. The hole is of a diameter sufficient to receive the sharp, pointed end of a tee or some similar device. The hole may be formed in any suitable manner.

In operation of the invention, when a player wishes to lay his club down on the grass, he inserts the sharp, tip end of a tee 50 into the hole 40 and places the large end of the tee on the grass with the club grip supported off the grass by the length of the tee as illustrated in FIG. 2.

It is clear that the invention may be practiced with other devices than a tee although a tee is convenient since it is carried by all golfers. In addition, the hole 40 can be placed wherever convenient on the club grip.

What is claimed is:

1. A golf club assembly comprising a golf club and an elongated tee, said golf club including a shaft having a head at one end for striking a ball and a grip at the opposite end thereof remote from said head, a small hole in said grip, said tee being generally conical in form and including a large area end and a pointed end remote therefrom, said tee having its pointed end inserted in said hole in said grip and disposed with its large area end supported on the grass when the club is laid on the grass whereby the grip is held a substantial distance above the grass and protected from water or other matter on the grass.

* * * * *